US012453388B2

(12) United States Patent
Dorsey, Jr.

(10) Patent No.: US 12,453,388 B2
(45) Date of Patent: Oct. 28, 2025

(54) LOAD BEARING POCKET INSERT

(71) Applicant: Wesley C. Dorsey, Jr., San Diego, CA (US)

(72) Inventor: Wesley C. Dorsey, Jr., San Diego, CA (US)

( * ) Notice: Subject to any disclaimer, the term of this patent is extended or adjusted under 35 U.S.C. 154(b) by 106 days.

(21) Appl. No.: 18/088,388

(22) Filed: Dec. 23, 2022

(65) Prior Publication Data

US 2023/0200462 A1 Jun. 29, 2023

Related U.S. Application Data

(60) Provisional application No. 63/265,945, filed on Dec. 23, 2021.

(51) Int. Cl.
*A41D 27/20* (2006.01)
*A45F 3/00* (2006.01)
*A45F 5/00* (2006.01)

(52) U.S. Cl.
CPC ..... *A41D 27/20* (2013.01); *A45F 2003/006* (2013.01); *A45F 5/00* (2013.01)

(58) Field of Classification Search
CPC ..... A41D 27/20; A45F 5/00; A45F 2003/006
USPC ..... 224/576, 230
See application file for complete search history.

(56) References Cited

U.S. PATENT DOCUMENTS 1,121,465 A * 12/1914 Brown ..... A45C 13/185 150/134
1,833,222 A * 11/1931 Lischeid ..... B43K 23/001 224/230
1,887,780 A * 11/1932 Noel ..... A45F 5/022 224/230
2,891,592 A * 6/1959 Vaca ..... A45C 13/185 150/134
3,051,130 A * 8/1962 Morris ..... A45F 5/02 24/11 R
3,142,876 A * 8/1964 Roberts ..... A41D 27/20 150/134
3,295,235 A * 1/1967 Tauber ..... G09F 3/185 224/230
3,371,829 A * 3/1968 Phillips ..... G09F 3/185 283/77
3,462,801 A * 8/1969 Bortle ..... A45C 13/185 150/134
3,741,376 A * 6/1973 Brown ..... A45F 5/02 224/183
3,797,717 A * 3/1974 Collins ..... A45C 11/00 224/230
4,310,109 A * 1/1982 Coyle ..... A45C 11/34 206/371
4,416,315 A * 11/1983 Foley ..... A45C 13/18 224/230

(Continued)

*Primary Examiner* — Peter N Helvey
(74) *Attorney, Agent, or Firm* — Cynthia S. Lamon; Lamon Patent Services

(57) ABSTRACT

A load bearing apparatus has a substantially rigid insertion panel of a width and height to slip fit to internal dimensions of a pocket of a garment, a first portion of an attachment mechanism coupled to an upper edge of the insertion panel, and one or more flexible extensions joined proximate the upper edge of the insertion panel and having an attachment element at an opposite end of the one or more flexible extensions configured to attach to compatible elements on a front surface of the pocket.

11 Claims, 7 Drawing Sheets

(56) References Cited

U.S. PATENT DOCUMENTS

| | | | | | |
|---|---|---|---|---|---|
| 4,667,347 | A * | 5/1987 | Greer | A41D 27/20 | 2/254 |
| 5,215,237 | A * | 6/1993 | Wu | A45C 13/20 | 150/132 |
| 5,497,818 | A * | 3/1996 | Marcarelli | A45C 13/185 | 224/675 |
| 6,035,564 | A * | 3/2000 | Cosmo | G09F 3/207 | 24/3.11 |
| 6,226,905 | B1 * | 5/2001 | Osuna | G09F 3/207 | 40/1.6 |
| 6,839,993 | B1 * | 1/2005 | Piche | G09F 3/207 | 24/3.1 |
| 7,681,255 | B2 * | 3/2010 | Morales | A41D 27/20 | 2/253 |
| 7,854,021 | B2 * | 12/2010 | Compton | A41D 27/08 | 2/243.1 |
| 8,511,508 | B1 * | 8/2013 | Glover | A45F 5/022 | 220/729 |
| 8,950,639 | B1 * | 2/2015 | Moss | B43K 23/001 | 224/230 |
| 2011/0307420 | A1 * | 12/2011 | Shaw | A41D 27/08 | 2/244 |
| 2012/0096628 | A1 * | 4/2012 | Grady | A41D 27/204 | 2/249 |
| 2018/0116316 | A1 * | 5/2018 | Raymond | A45F 5/022 | |

* cited by examiner

LOAD BEARING POCKET INSERT

CROSS-REFERENCE TO RELATED DOCUMENTS

This application claims priority to U.S. Provisional Patent Application No. 63/265,945, filed in the US on Dec. 23, 2021, the disclosure of which is incorporated by reference in its entirety.

BACKGROUND OF THE INVENTION

1. Field of the Invention

The present invention is in the technical field of apparatus implemented to adapt clothing for carrying equipment and articles outside the clothing and pertains more particularly to an adapter for pockets for suspending equipment.

2. Description of Related Art

Military and law enforcement personnel, fire fighters, medical personnel, security professionals, and outdoor enthusiasts wear belts to which they can attach a variety of items such as bags, pouches, pistols, flashlights, magazine clips, first aid kits, handcuffs, knives, and so on. To increase a wearer's carrying capacity, drop leg or thigh rig attachment systems have been developed for carrying additional equipment on the leg of the wearer. These systems consist generally of one or more primary support straps that attach to a belt at one end, a mounting platform, bag, or pouch attached to the other end of the primary support strap(s). One or more secondary support straps may be attached to the equipment. Secondary support strap(s) may be secured around the leg of the wearer. The primary and secondary straps function to both support the attached equipment and limit movement of the equipment during physical activity. One example of such a system in the prior art is U.S. Pat. No. 4,848,624 by Ronald D. Clem.

A disadvantage of drop leg attachment systems is that the primary support strap(s) take up valuable space on the wearer's belt. The space on a wearer's belt is limited and valuable. Another disadvantage to drop leg systems is that even with the primary support strap(s) attached at the wearer's belt, and the secondary strap(s) fastened around the wearer's leg, the equipment attached to the drop leg system can still rotate around the wearer's leg during physical activity. A solution to this problem is to tighten the secondary strap(s) as much as possible to prevent rotation. But in many instances, tightening the secondary straps sufficiently to prevent rotation of the equipment also causes pinching, chaffing, restricted blood circulation, or other discomfort to the leg of the wearer.

The present inventor has determined that what is clearly needed is freeing up space on a wearer's belt occupied by the primary support strap(s), by relocating the support function of the primary strap(s) from the belt to a pocket of the wearer's clothing or uniform. This might allow a wearer to carry additional equipment and still have a fully functional drop leg attachment system.

BRIEF SUMMARY OF THE INVENTION

In one embodiment of the invention load bearing apparatus is provided, comprising a substantially rigid insertion panel of a width, and height to slip fit to internal dimensions of a pocket of a garment, a first portion of an attachment mechanism coupled to an upper edge of the insertion panel, and one or more flexible extensions joined proximate the upper edge of the insertion panel and having an attachment element at an opposite end of the one or more flexible extensions configured to attach to compatible elements on a front surface of the pocket. In one embodiment the first portion of the attachment mechanism is a male or female portion of a snap-in buckle. Also, in one embodiment the flexible extensions are fabric straps sewn through slots proximate the upper edge of the insertion panel and the attachment elements at the opposite ends are buttonholes. In one embodiment the insertion panel is formed from metal, plastic, polymer, carbon fiber, or wood, and in one embodiment the insertion panel is covered with a cushioning material.

In one embodiment of the apparatus the insertion panel is formed in a curved shape to conform to a curved shape of a wearer where the panel is mounted. Also in one embodiment the first portion of an attachment mechanism coupled to an upper edge of the insertion panel is one of an eyelet, a cleat, a snap, a buckle, a hook, a loop, or a clip. In one embodiment the apparatus further comprises an equipment element having a male or female portion of a snap-in buckle connected to the equipment element and engaging the male or female portion of a snap-in buckle attached to the upper edge of the insertion panel.

In one embodiment of the apparatus the equipment element is a Modular Lightweight Load-carrying Equipment (MOLLE) panel having a first and a second leg strap, each ending in a compatible snap-in buckle portion, enabling the wearer to strap the MOLLE panel around the wearer's thigh with the insertion panel in a thigh pocket of the garment. Also, in one embodiment of the apparatus the equipment element is a container, a bag, a pouch, a panel, or an electronic device. In one embodiment the insertion panel has circuitry and interfaces to function as a battery or an electronic device.

In another aspect of the invention a method of carrying equipment is provided, comprising inserting a substantially rigid insertion panel of a width and height to slip fit to internal dimensions of a pocket of a garment into the pocket, the insertion panel having a first portion of an attachment mechanism coupled to an upper edge of the insertion panel and one or more flexible extensions joined proximate the upper edge of the insertion panel and having an attachment element at an opposite end of the one or more flexible extensions configured to attach to compatible elements on a front surface of the pocket, coupling the attachment elements at the ends of the flexible extensions to the compatible elements of the front of the pocket, securing the insertion panel in the pocket, joining an equipment element having first and second leg straps ending in compatible portions of a snap-in buckle to the insertion panel by a second portion of an attachment mechanism compatible with the first portion of the attachment mechanism joined to the upper edge of the insertion panel, and buckling the leg straps around a thigh of the wearer.

DETAILED DESCRIPTION OF THE INVENTION

Figure 1C:
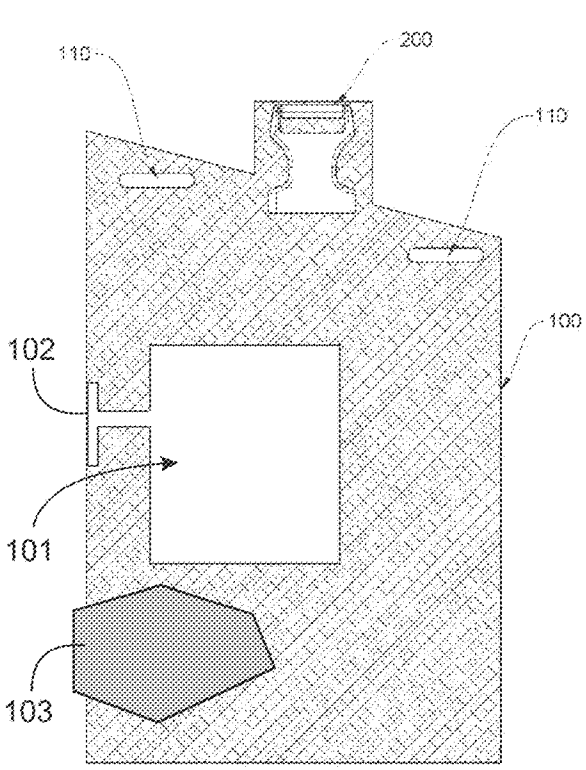
FIG. 1C is a front elevation view of an insertion panel with circuitry and interfaces to enable performance as an electronic device as well as an insertion panel in an embodiment of the invention.

In this specification the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device necessarily has to be used or positioned in any particular orientation.

Figure 1B:
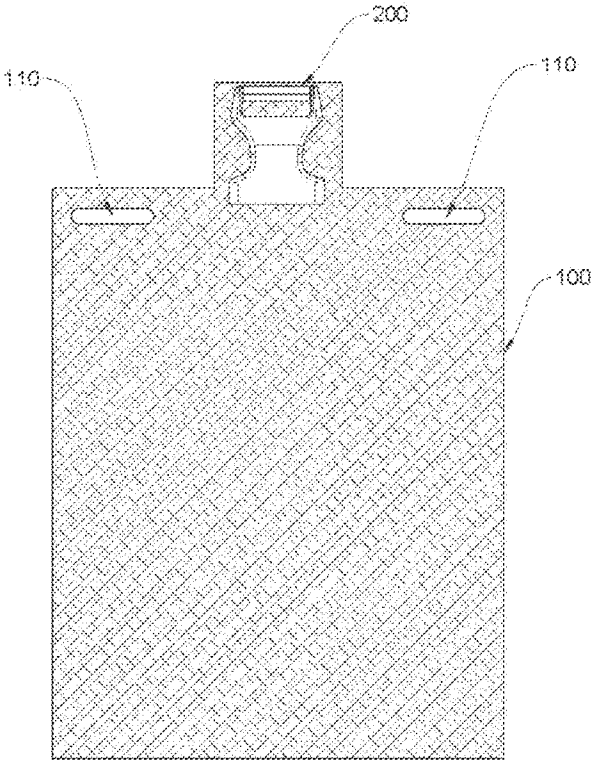
FIG. 1B is a front elevation view of an insertion panel according to an embodiment of the invention for a straight pocket.
Figure 1A:
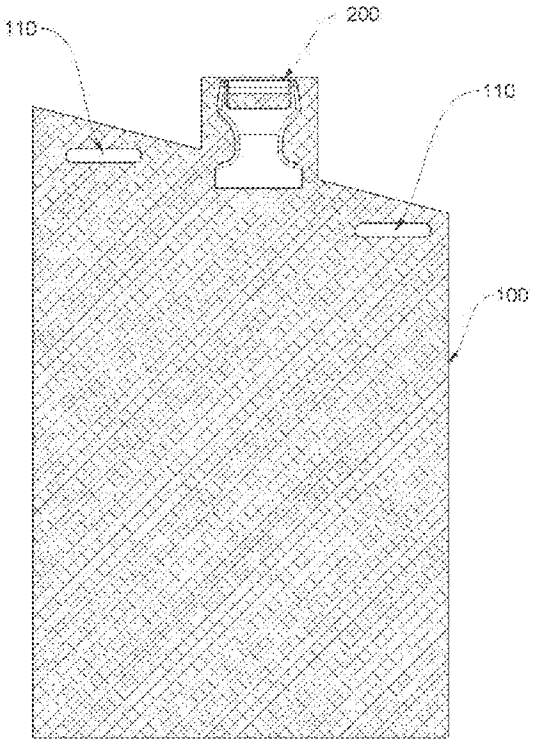
FIG. 1A is a front elevation view of an insertion panel according to an embodiment of the invention for an angled pocket.

FIG. 1A is a front elevation view of an insertion panel 100 configured to be used with an angled pocket attached to clothing. FIG. 1B is a front elevation view of an insertion panel 100 configured to be used with a straight pocket attached to clothing. It will be apparent to the skilled person that the difference in the insertion panel for a straight or an angled pocket is the angle of the top edge of the panel with the sides of the panel. In one embodiment the pocket may be a thigh pocket of work trousers or a military uniform. Insertion panel 100 is a rigid or semi-rigid resilient panel that can be formed from a variety of materials. Examples of such materials are metals, plastics, polymers, carbon-fiber, and wood. Insertion panel 100 is formed to fit closely within the interior dimensions of the pocket to which it applies. In another embodiment of the invention, insertion panel 100 may be enclosed in cushioning material, such as cotton batting, for additional comfort of the wearer.

In yet another embodiment of the invention, insertion panel 100 is further configured with a curvature to more closely fit a body part that rests against the pocket in which insertion panel 100 is inserted, which in some instances may be a wearer's thigh. In yet another embodiment, insertion panel 100 is configured internally with materials, and components, and interfaces to allow the panel to function as a battery as well as a pocket mounted load bearing system.

In yet another embodiment of the invention, insertion panel 100 is configured internally with materials, and components, and interfaces to allow it to function as a variety of devices such as radio transmitter/receivers, Wi-Fi transmitter/receivers, or GPS devices while still maintaining the function of a pocket mounted load bearing system.

FIG. 1C is a front elevation view of an insertion panel with circuitry 101 and interfaces 102, including input and output mechanisms, to enable performance as an electronic device as well as an insertion panel in an embodiment of the invention. Additionally in FIG. 1C a portion of a cushioning material 103 is shown that may cover one side or both sides of the insertion panel.

Integrated into insertion panel 100 are insertion panel mounting points 110 which in the instant embodiment are rectangular eyelets cut into insertion panel 100. Also integrated into insertion panel 100 is insertion panel attachment point 200 which in the instant embodiment is the female end of a snap-in buckle. In another embodiment this might be the male end of the snap-in buckle.

Figure 2B:
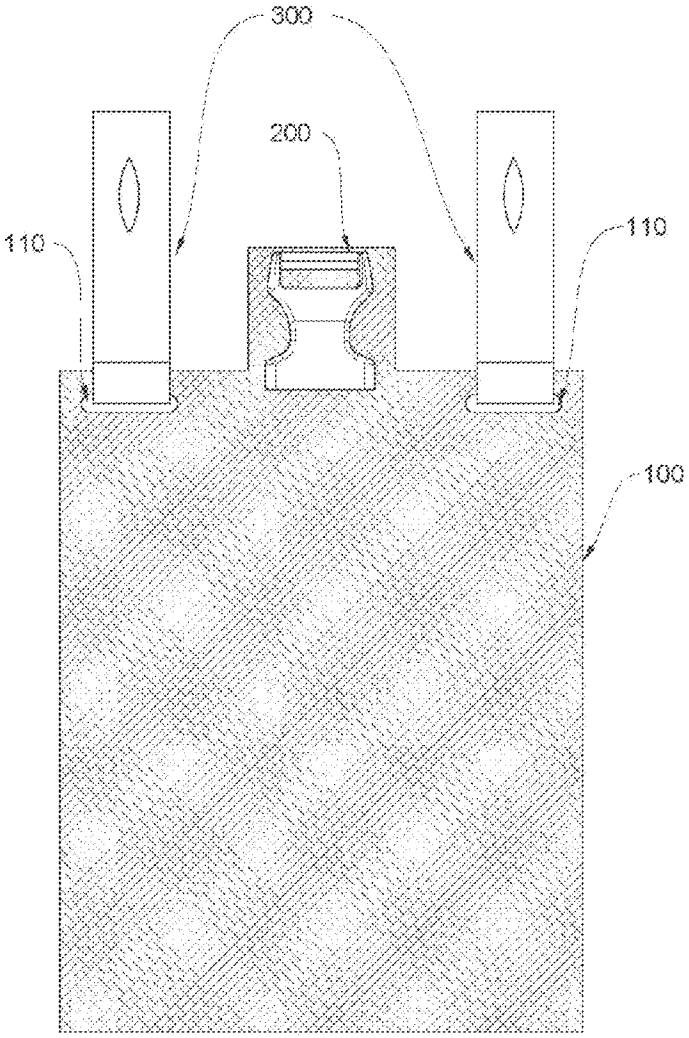
FIG. 2B shows the insertion panel of FIG. 1B with added straps.
Figure 2A:
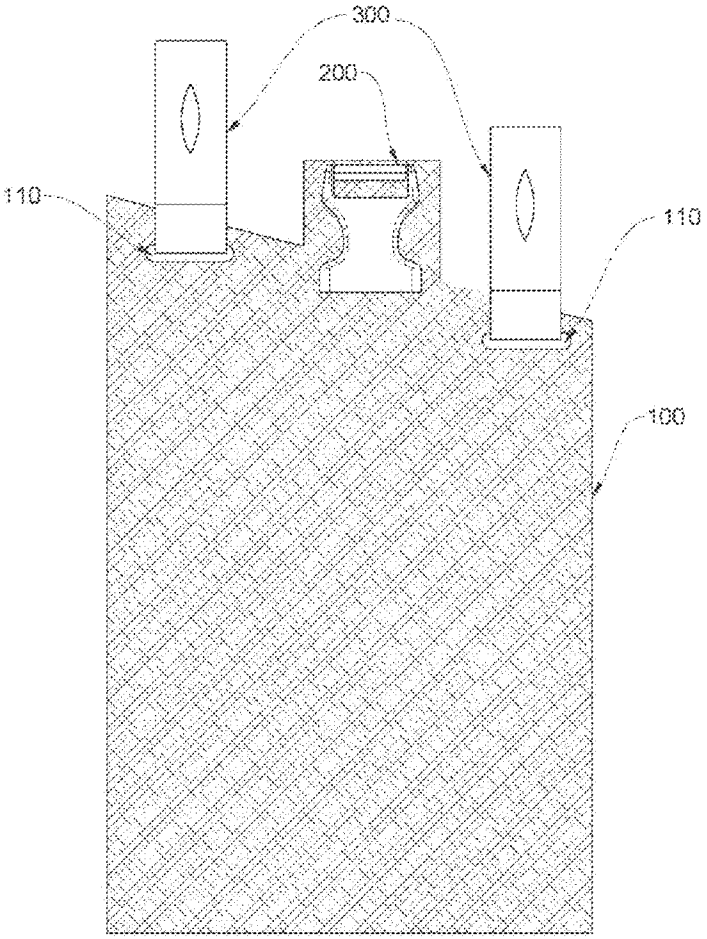
FIG. 2A shows the insertion panel of FIG. 1A with added straps.

FIG. 2A is a front elevation view of insertion panel 100 for an angled pocket with insertion panel mounting elements 300 attached to insertion panel mounting points 110. FIG. 2B shows the mounting elements 300 attached for a straight pocket circumstance. In the instant embodiment, insertion panel mounting element 300 is a fabric strap with a first end, which is looped through the insertion panel mounting point 110 and sewn back on itself. A second end of the strap is configured with a buttonhole.

Figure 3:
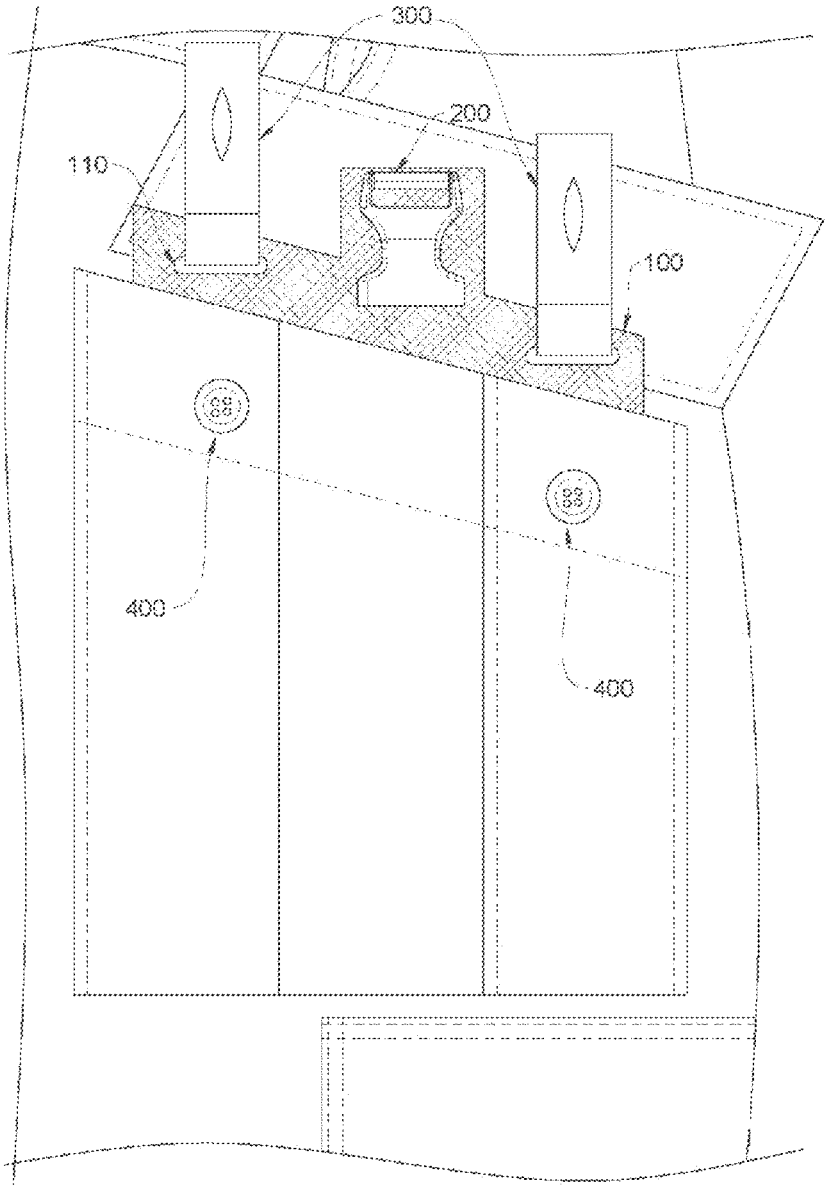
FIG. 3 shows the insertion panel of FIG. 2A inserted into a thigh pocket on a pant in an embodiment of the invention.

FIG. 3 is a front elevation view of insertion panel 100 inserted into an angled thigh pocket. The pocket has, in this example, mounting points 400, which in the instant embodiment are buttons.

Figure 4:
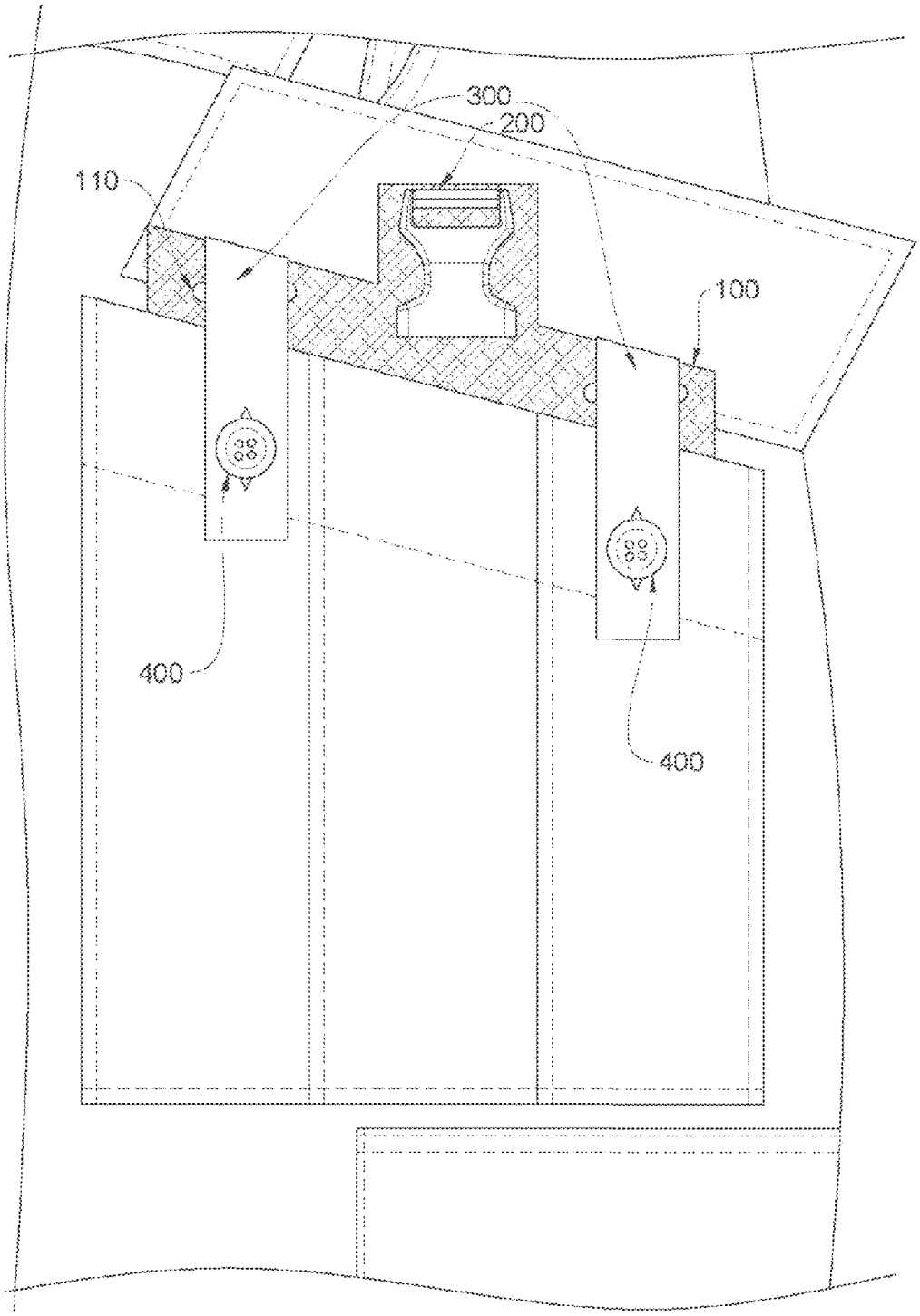
FIG. 4 shows the insertion panel of FIG. 3 inserted into the thigh pocket with an insertion panel mounting apparatus attached to pocket mounting points in an embodiment of the invention.

FIG. 4 is a front elevation view of insertion panel 100 inserted into an angled thigh pocket. In this example the buttonhole end of the straps 300 are engaged to the mounting points 400, which in the instant embodiment are buttons on the pocket. The skilled person will understand that the same may be done for the straight pocket circumstance.

Figure 5:
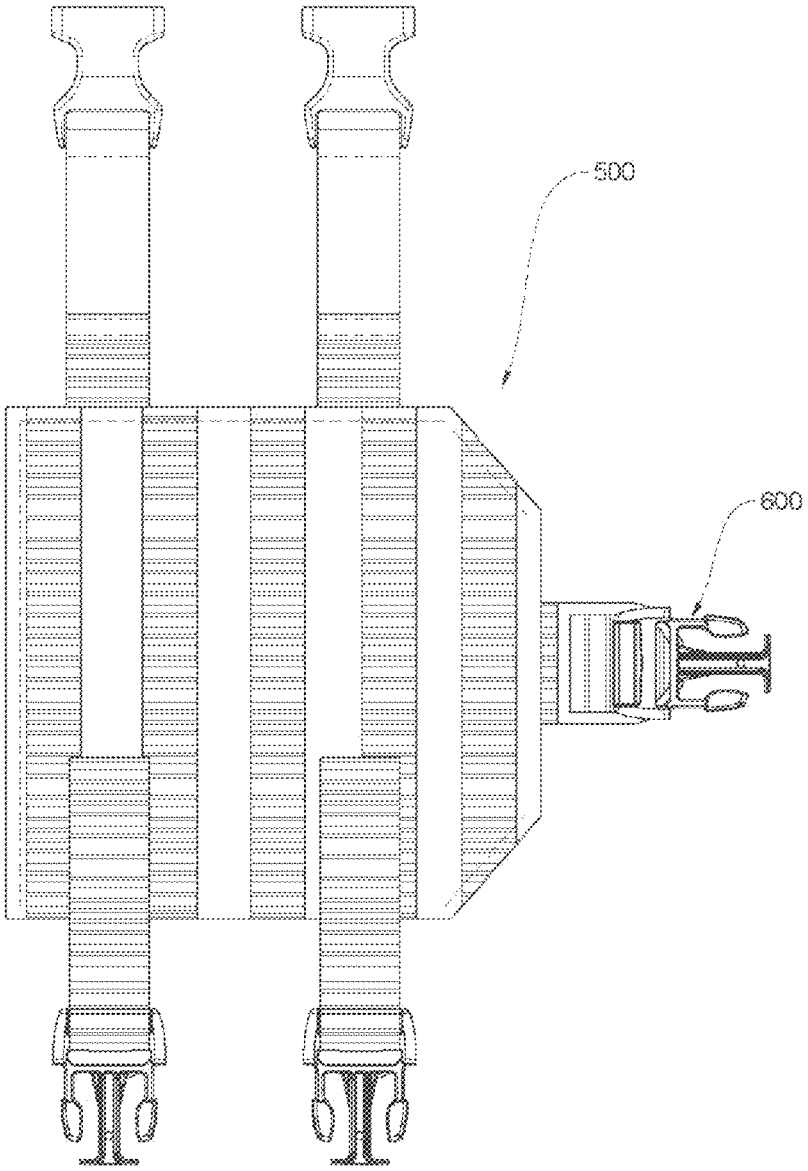
FIG. 5 shows equipment configured with an equipment attachment mechanism in an embodiment of the invention.

FIG. 5 is a front elevation view of an equipment element 500, which in the instant embodiment is a MOLLE panel. MOLLE stands for Modular Lightweight Load-carrying Equipment. A MOLLE Panel is an organizational grid used on backpacks or vests and allows a wearer to attach and hold many different pieces of gear. MOLLE Panel 500 in this example is configured with equipment attachment means 600, in this example a male portion of a snap-in buckle, and two leg straps (unnumbered), each of which have snap-in buckles for fastening around the wearer's thigh. Element 500 in other embodiments may be any one of a plurality of bags, pouches, kits, accessories, and accessory holders.

Figure 6:
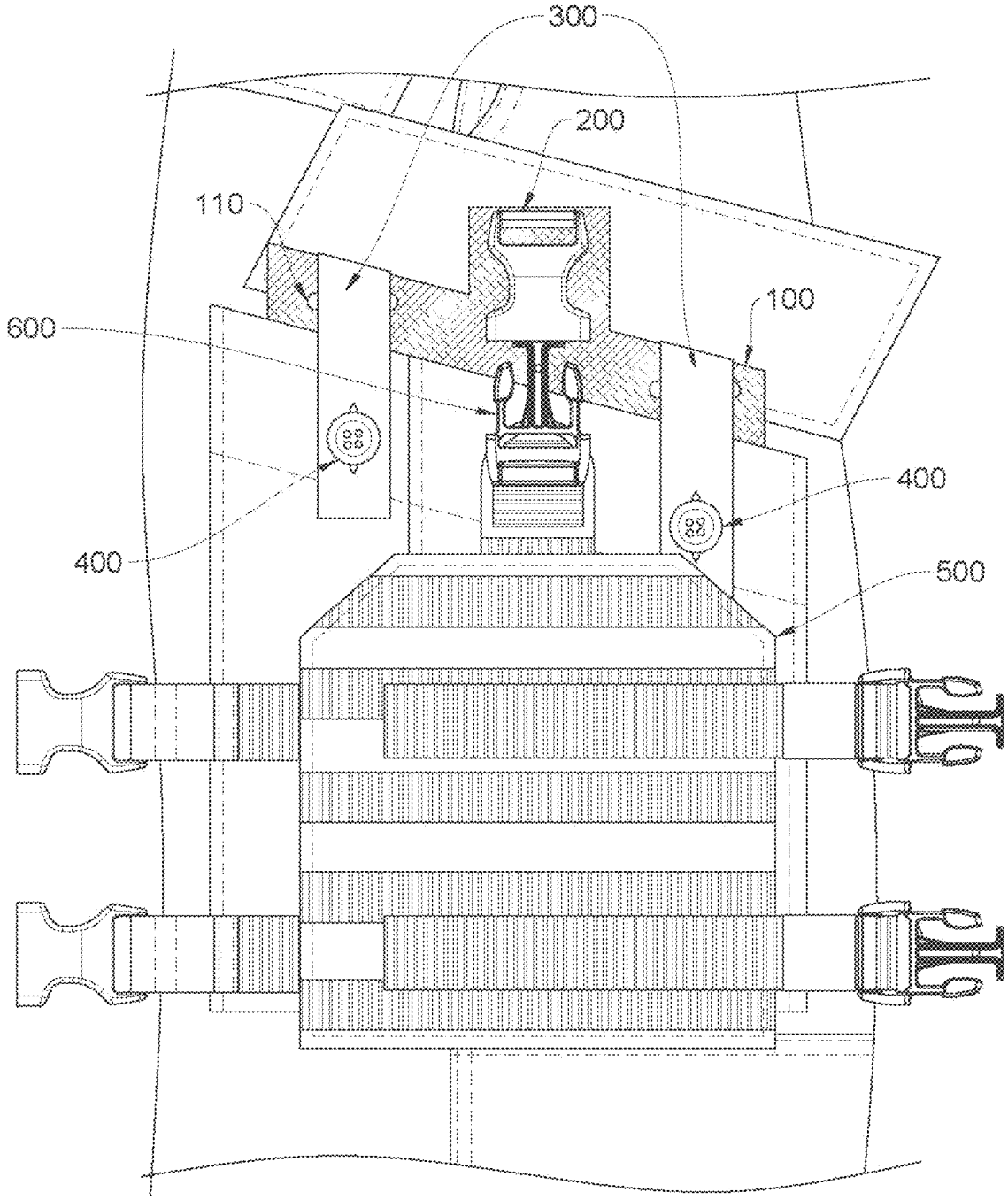
FIG. 6 shows the insertion panel inserted into to the thigh pocket, the equipment of FIG. 5 ready to be attached to the insertion panel of FIG. 4 with leg straps ready to be secured around the leg of a wearer in an embodiment of the invention.

FIG. 6 is a front elevation view of equipment 500 ready to be attached to the insertion panel 100 by inserting the male buckle portion 600 into the female buckle portion 200 of the insertion panel.

Figure 7:
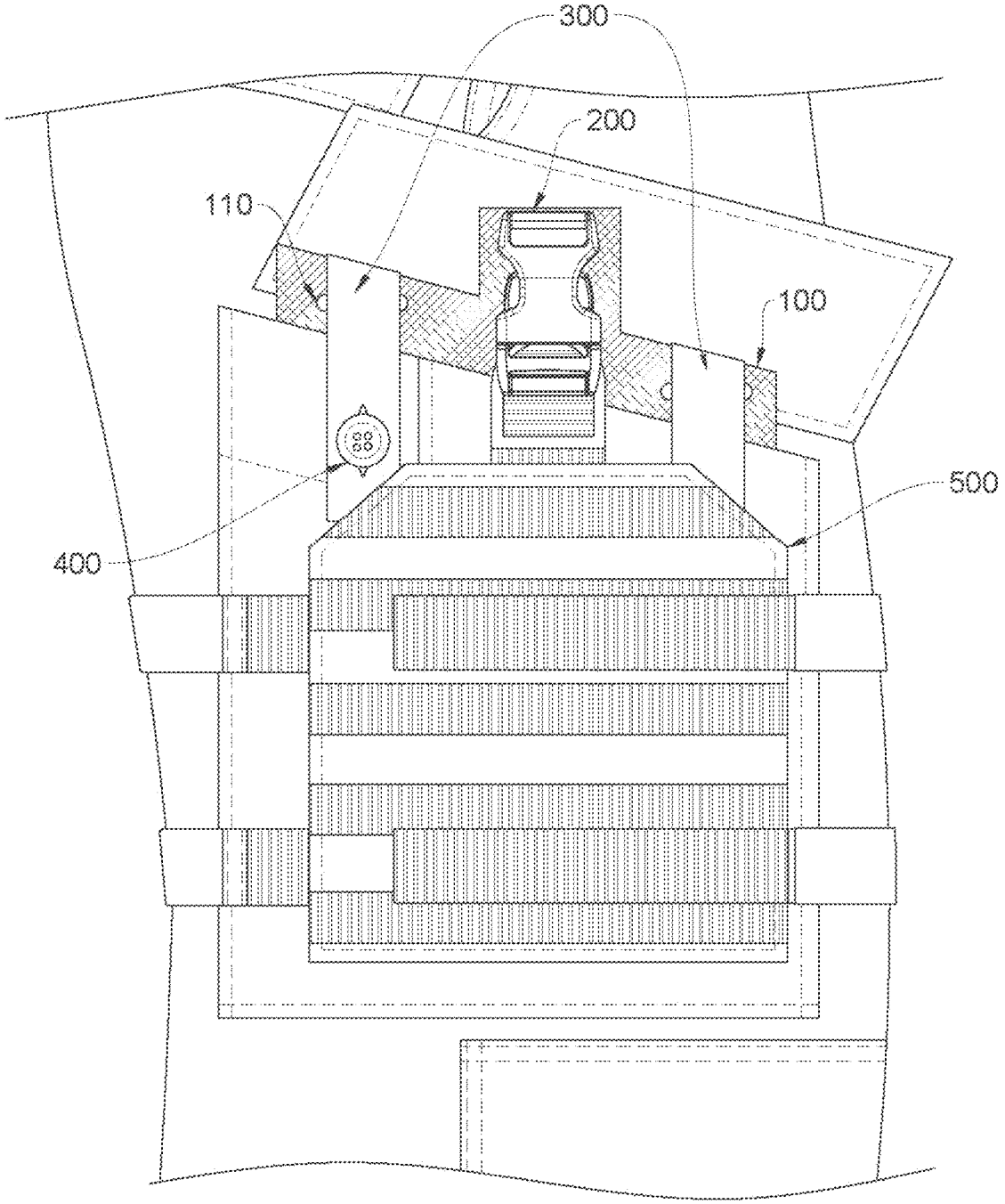
FIG. 7 shows the equipment of FIG. 6 attached to the insertion panel of FIG. 4, the leg straps of the equipment secured around the leg of the wearer in an embodiment of the invention.

FIG. 7 is a front elevation view of equipment 500 fully mounted onto insertion panel 100 and secured to the leg of the wearer. The leg straps are wrapped around the wearer's leg and the buckles on the leg straps of FIG. 6 are coupled behind the wearer's leg. Buckle portion 200 is snapped-into the female buckle portion of the insertion panel. Because of inherent limited movement of the thigh pocket, which is permanently sewn into the garment, and the attachment of straps 300 to button 400, the need to attach further support for equipment 500 to the belt of the wearer has been eliminated. The space on the wearer's belt, previously taken up by the primary support strap in the prior art can now be used for the attachment of other accessories. Additionally, because of the inherent limited movement of the thigh pocket, the 500 leg straps may not require excessive tightening to prevent unintended rotation of equipment when the wearer is performing physical activity.

It is additionally noted and anticipated that although the device is shown in a simple form, various components and aspects of the device may be differently shaped or somewhat modified when implementing the invention. As such, those skilled in the art will appreciate that the descriptions and depictions set forth in this specification are merely meant to portray examples within the overall scope and intent of the invention and are not to be considered limiting in any manner.

While all the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention. It should also be understood that various substitutions, modifications, and variations may be made by those skilled in the art without departing from the scope of the invention. Consequently, all such modifications and variations and substitutions are included within the scope of the invention as defined by the following claims.

The invention claimed is:

1. A load bearing apparatus, comprising:

a substantially rigid insertion panel of a width and height to slip fit to internal dimensions of a pocket of a garment;

a male or female portion of a snap-in buckle coupled to an upper edge of the insertion panel; and one or more flexible extensions joined proximate the upper edge of the insertion panel and having an attachment element at an opposite end of the one or more flexible extensions configured to attach to compatible elements on a front surface of the pocket.

2. The apparatus of claim 1 wherein the flexible extensions are fabric straps sewn through slots proximate the upper edge of the insertion panel and the attachment elements at the opposite ends are buttonholes.

3. The apparatus of claim 1 wherein the insertion panel is formed from any one or more of metal, plastic, polymer, carbon fiber, or wood.

4. The apparatus of claim 1 wherein the insertion panel is covered with a cushioning material.

5. The apparatus of claim 1 wherein the insertion panel is formed in a curved shape to conform to a curved shape of a wearer where the panel is mounted.

6. The apparatus of claim 1 wherein the first portion of an attachment mechanism coupled to an upper edge of the insertion panel is one of an eyelet, a cleat, a snap, a buckle, a hook, a loop, or a clip.

7. The apparatus of claim 1 further comprising an equipment element having a male or female portion of a snap-in buckle connected to the equipment element and engaging the male or female portion of a snap-in buckle attached to the upper edge of the insertion panel.

8. The apparatus of claim 7 wherein the equipment element is a Modular Lightweight Load-carrying Equipment (MOLLE) panel having a first and a second leg strap, each ending in a compatible snap-in buckle portion, enabling the wearer to strap the MOLLE panel around the wearer's thigh with the insertion panel in a thigh pocket of the garment.

9. The apparatus of claim 7 wherein the equipment element is a container, a bag, a pouch, a panel, or an electronic device.

10. The apparatus of claim 1 wherein the insertion panel has circuitry and interfaces to function as a battery or an electronic device.

11. A method of carrying equipment, comprising:

inserting a substantially rigid insertion panel of a width and height to slip fit to internal dimensions of a pocket of a garment into the pocket, the insertion panel having a male or female portion of a snap-in buckle coupled to an upper edge of the insertion panel and one or more flexible extensions joined proximate the upper edge of the insertion panel and having an attachment element at an opposite end of the one or more flexible extensions configured to attach to compatible elements on a front surface of the pocket;

coupling the attachment elements at the ends of the flexible extensions to the compatible elements of the front of the pocket, securing an equipment element having first and second leg straps ending in compatible portions of a snap-in buckle to the insertion panel by a second portion of an attachment mechanism compatible with the first portion of the attachment mechanism joined to the upper edge of the insertion panel; and buckling the leg straps around a thigh of the wearer.

* * * * *